US010851567B2

(12) United States Patent
Sharp

(10) Patent No.: US 10,851,567 B2
(45) Date of Patent: Dec. 1, 2020

(54) FRONT PULL LATCH

(71) Applicant: Snap-on Incorporated, Kenosha, WI (US)

(72) Inventor: William T. Sharp, Pleasant Prairie, WI (US)

(73) Assignee: Snap-on Incorporated, Kenosha, WI (US)

( * ) Notice: Subject to any disclaimer, the term of this patent is extended or adjusted under 35 U.S.C. 154(b) by 498 days.

(21) Appl. No.: 15/703,298

(22) Filed: Sep. 13, 2017

(65) Prior Publication Data

US 2018/0320422 A1 Nov. 8, 2018

Related U.S. Application Data

(60) Provisional application No. 62/503,125, filed on May 8, 2017.

(51) Int. Cl.

| | |
|---|---|
| ***E05B 65/46*** | (2017.01) |
| ***E05C 1/14*** | (2006.01) |
| *E05B 15/00* | (2006.01) |

(52) U.S. Cl.

CPC ..... *E05C 1/14* (2013.01); *E05B 65/46* (2013.01); *Y10T 292/097* (2015.04); *Y10T 292/0969* (2015.04); *Y10T 292/0977* (2015.04)

(58) Field of Classification Search

CPC ..... Y10T 292/0969; Y10T 292/097; Y10T 292/0977; Y10T 292/0995; Y10T 292/084; Y10T 292/0976; E05B 65/46

USPC ..... 312/348.4, 332.1, 228.1

See application file for complete search history.

(56) References Cited

U.S. PATENT DOCUMENTS

| | | | |
|---|---|---|---|
| 1,897,080 | A | 2/1933 | Soper |
| 4,781,407 | A | 11/1988 | Rauchhaus |
| 5,388,902 | A | 2/1995 | Huebschen |
| 5,403,139 | A | 4/1995 | Slivon et al. |
| 5,413,391 | A | 5/1995 | Clavin et al. |
| 5,769,517 | A | 6/1998 | Carde |
| 5,820,175 | A | 10/1998 | Clavin |
| 6,120,069 | A | 9/2000 | Taranto |
| 6,145,352 | A | 11/2000 | Vickers et al. |
| 6,669,243 | B2 | 12/2003 | Katoh et al. |

(Continued)

FOREIGN PATENT DOCUMENTS

| | | |
|---|---|---|
| CN | 201468549 | 5/2010 |
| CN | 205568362 | 9/2016 |

(Continued)

OTHER PUBLICATIONS

Australian Examination Report for Application No. 2018202219 dated Feb. 18, 2019, 3 pages.

(Continued)

*Primary Examiner* — Carlos Lugo

(74) *Attorney, Agent, or Firm* — Seyfarth Shaw LLP

(57) ABSTRACT

A latch that can be unlatched with a force exerted on a front handle of a drawer or other enclosure. The latch includes an end cap that interacts with a cam surface of a body and, upon doing so, disengages the catch from an opening on a strike plate or cabinet body. When the catch is disengaged, the latch can allow for the opening of the enclosure. The latch therefore allows for a simple forward motion to open and close the latch, and further allows the latch to be used with many different enclosures.

15 Claims, 6 Drawing Sheets

(56) References Cited

U.S. PATENT DOCUMENTS

| | | | | |
|---|---|---|---|---|
| 6,851,286 | B2 | 2/2005 | Dube et al. | |
| 7,182,373 | B2 | 2/2007 | Yamada | |
| 7,410,194 | B2 * | 8/2008 | Chen | E05C 1/14 292/37 |
| 7,695,028 | B2 | 4/2010 | Katou et al. | |
| 7,806,446 | B2 * | 10/2010 | Oh | B60R 7/06 292/137 |
| 8,033,582 | B2 | 10/2011 | Sawatani et al. | |
| 8,403,374 | B2 | 3/2013 | Shimizu et al. | |
| 8,590,351 | B2 | 11/2013 | Ookawara et al. | |
| 9,556,654 | B2 | 1/2017 | Fukumoto | |
| 2011/0121701 | A1 | 5/2011 | Chang | |
| 2011/0309730 | A1 | 12/2011 | Retchloff et al. | |
| 2015/0327676 | A1 | 11/2015 | Chang | |
| 2016/0128471 | A1 * | 5/2016 | Chang | B25H 3/028 312/249.11 |

FOREIGN PATENT DOCUMENTS

| | | | | |
|---|---|---|---|---|
| EP | 0511918 | A1 * | 11/1992 | E05C 1/10 |
| EP | 2213819 | A2 * | 8/2010 | E05B 63/006 |
| EP | 3147435 | | 3/2017 | |
| JP | 2016017302 | | 2/2016 | |
| TW | M285602 | | 1/2006 | |
| TW | 345113 | | 11/2008 | |
| TW | 201619483 | | 6/2016 | |

OTHER PUBLICATIONS

Chinese Office Action for Application No. 2018104271759, dated Aug. 14, 2019, 8 pages.

Taiwan Office Action for Application No. 107115197, dated Jan. 15, 2019, 7 pages.

United Kingdom Combined Search and Examination Report for Application No. GB1805210.0 dated Sep. 21, 2018, 6 pages.

Canadian Examination Report for Application No. 3,001,363 dated Mar. 18, 2019, 3 pages.

Chinese Office Action for Application No. 201810427175.9 dated Mar. 20, 2020, 3 pages.

* cited by examiner

FRONT PULL LATCH

RELATED APPLICATIONS

The present application is a non-provisional application of, and claims the filing benefit of, provisional patent application Ser. No. 62/503,125, filed May 8, 2017, the disclosure of which is incorporated herein in its entirety.

TECHNICAL FIELD OF THE INVENTION

The present invention relates generally to latches. More particularly, the present invention relates to a latch capable of being unlatched with a pulling motion on the front of a cabinet drawer or other enclosure.

BACKGROUND OF THE INVENTION

Latches are a common mechanical device for allowing the selective latching and unlatching of a drawer, cabinet, or other enclosure. A latch can include a catch that engages an opening in a cabinet or strike plate. The catch maintains the enclosure in the closed position when the catch is engaged with the opening (e.g. locked or latched condition), and allows the enclosure to open when the catch is disengaged from the opening (e.g., unlocked or unlatched condition). Various latches have different mechanisms for allowing the selective engagement of the catch.

For some latches, including many that are present in toolboxes or roll cabs, it can be difficult to open and close the enclosure against the latch. Many enclosures do not include a simple and comfortable method of unlatching the latch to allow the enclosure to be opened and instead require two hands or an awkward motion for unlatching the catch to allow opening of the enclosure.

Other latches are simple and comfortable to open but require a special configuration to implement the latch on the enclosure. For example, some latches can be unlatched with a force exerted on the front handle of a roll cab drawer. However, such a latch may require special tooling in the roll cab itself, requiring additional expense and less versatility of the latch.

SUMMARY OF THE INVENTION

The present invention broadly comprises a latch capable of being unlatched with a force exerted on a front handle of a drawer, such as typically used when opening the drawer. The latch includes an end cap with a portion that interacts with a cam surface of a body to selectively engage and disengage the latch upon receiving a force on the handle of the enclosure. The latch therefore allows for a simple and comfortable motion to open and close the latch, while also being capable of being inserted into a variety of different enclosures.

In an embodiment, the present invention broadly includes a latch including an end cap having a portion, and a body having a cam surface that engages the portion to move linearly inward when the portion rotates against the cam surface. The body further includes a catch that engages or disengages an opening based on the linear movement of the body, a spring that biases the body in an outward direction, and a holder receiving the body and having an abutment for receiving the spring to bias the body in the outward direction.

Another embodiment broadly includes an enclosure including a latch having an end cap with a portion, and a body having a cam surface that engages the portion to move linearly inward when the portion rotates against the cam surface. The body further includes a catch that engages or disengages an opening based on the linear movement of the body, a spring that biases the body in an outward direction, and a holder receiving the body and having an abutment for receiving the spring to bias the body in the outward direction. Further included is a handle coupled to the latch at the end cap, and an enclosure body receiving the handle and the latch.

Another embodiment broadly includes a method of opening an enclosure, including providing a latch including an end cap having a portion, a body having a cam surface that engages the portion to move linearly inward when the portion rotates against the cam surface, the body further including a catch that engages or disengages an opening based on the linear movement of the body, a spring that biases the body in an outward direction, and a holder receiving the body and having an abutment for receiving the spring to bias the body in the outward direction. The method further includes rotating a handle coupled to the end cap, and disengaging the catch from an opening upon the rotating of the handle.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
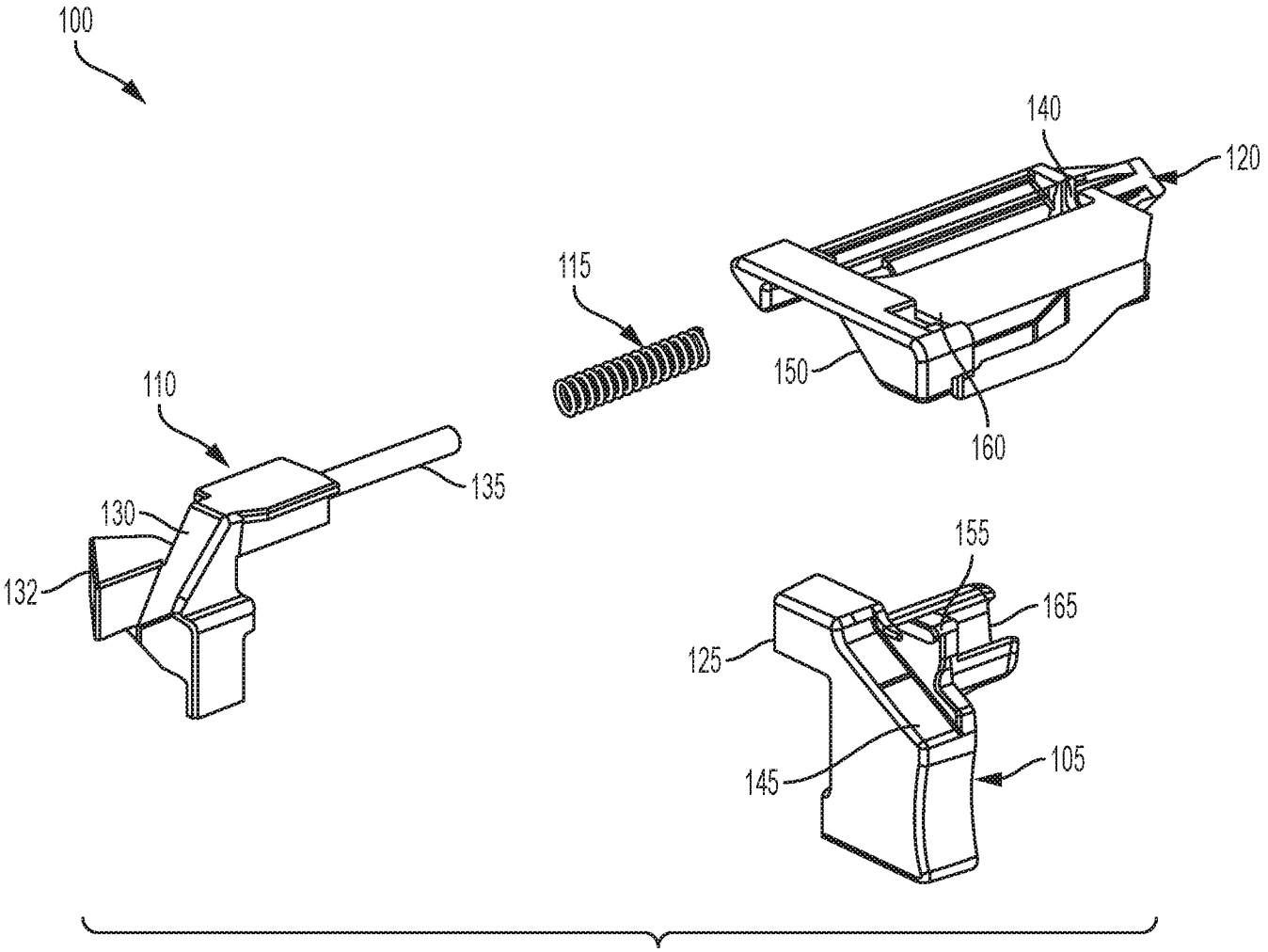
FIG. 1 is an exploded perspective view of a latch according to at least some embodiments of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises a latch designed to be opened with a force exerted on a front handle of a drawer or other enclosure. The latch includes an end cap that interacts with a cam surface of a body to selectively engage and disengage the catch of the latch upon receiving a front pull force on the handle of the enclosure. The latch can therefore be unlatched with a force applied to the front of the enclosure handle, while also being capable of being inserted into a variety of different enclosures.

Referring to FIGS. 1-6, a latch 100 can include an end cap 105 that engages a body 110 biased by a spring 115 and held by a holder 120. The end cap 105 can include a portion 125 that abuts a cam surface 130 of the body 110 to move the body 110 linearly inward against the bias of the spring 115 when the end cap 105 is rotated. In doing so, the body 110 can remove a catch 132 from an opening in a strike plate or other body, such as the cabinet itself. When the user chooses to latch the latch 100, the angled surface of the catch 132 will reengage the opening of the strike plate or cabinet (or other opening), and will latch with the bias of the spring 115 pushing the body 110 and catch 132 outward.

By placing the latch mechanism in the end cap 105, the latch 100 can be selectively latched (or locked) or unlatched (or unlocked) by pulling forward on a handle of a drawer or enclosure, as described below in more detail. This structure therefore allows a pull forward motion to unlatch the latch and open the enclosure, and further allows the latch to be inserted into a variety of enclosures for added versatility.

The spring 115 can be held on an extension 135 of the body 110 to prevent the spring 115 from escaping the latch 100 or otherwise not performing its intended function. For example, the spring 115 can be a coil spring as shown, and the extension 135 can be a rod-shaped body that is inserted through the middle of the spring 115 to hold the spring 115. Alternately, the spring 115 can be any other type of spring (e.g., a leaf spring or a compression spring).

The holder 120 can include an abutment 140 that acts as the mass that the spring 115 pushes against to bias the body 110 and catch 132 outward into the closed position. The abutment can be any structure that achieves this function, including, in an embodiment, a flat or indented portion that receives the spring 115 to prevent the spring 115 from escaping the holder 120 or extension 135.

Figure 6:
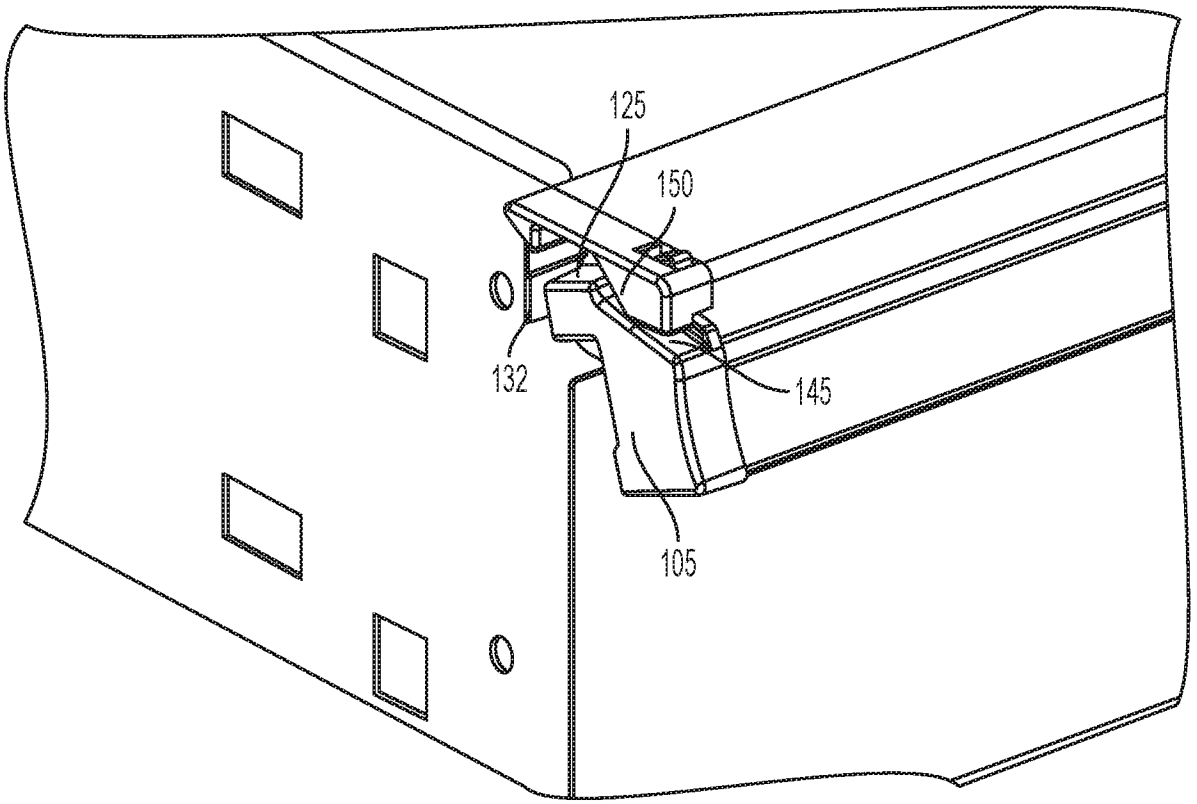
FIG. 6 is a front perspective view of a latch inserted into a drawer with a handle, where the latch is in the open or unlatched position.

The end cap 105 can include a first cam surface 145 that contacts a second cam surface 150 of the holder 120 when a user rotates the handle of the enclosure to unlatch the latch 100. For example, the first 145 and second 150 cam surfaces can be angled and engage one another when the latch 100 is rotated from the latched position to the unlatched position. In doing so, as shown in FIG. 6, the first cam surface 145 acts as a lever or pry against the second cam surface 150 to apply force from the portion 125 against the cam surface 130. This allows for a more comfortable unlatching of the latch 100 and opening of the enclosure with less effort on the part of the user.

The end cap 105 can also include a tab 155 that can be inserted into an aperture 160 to further couple the end cap 105 and the holder 120 together. In an embodiment, the tab 155 is movably inserted into the aperture 160 that acts as a guide for movement of the end cap 105 with respect to the holder 120. For example, as shown in FIGS. 5 and 6, the tab 155 can prevent further lateral movement of the end cap 105 and handle while the tab 155 can rotate freely within the aperture 160.

In some embodiments, the latch 100 can include a protrusion 165 that acts as a male member to be inserted into a female member within the enclosure. For example, as shown in FIG. 1, the end cap 105 can include a protrusion 165 that friction or interference fits into an opening in the enclosure. In this manner, the latch 100 can be coupled to an enclosure and allow the handle of the enclosure to operate and unlatch the latch 100 with a front pull. Any other manner of coupling the latch 100 to a handle or enclosure can be implemented without departing from the spirit and scope of the present invention.

Figure 2:
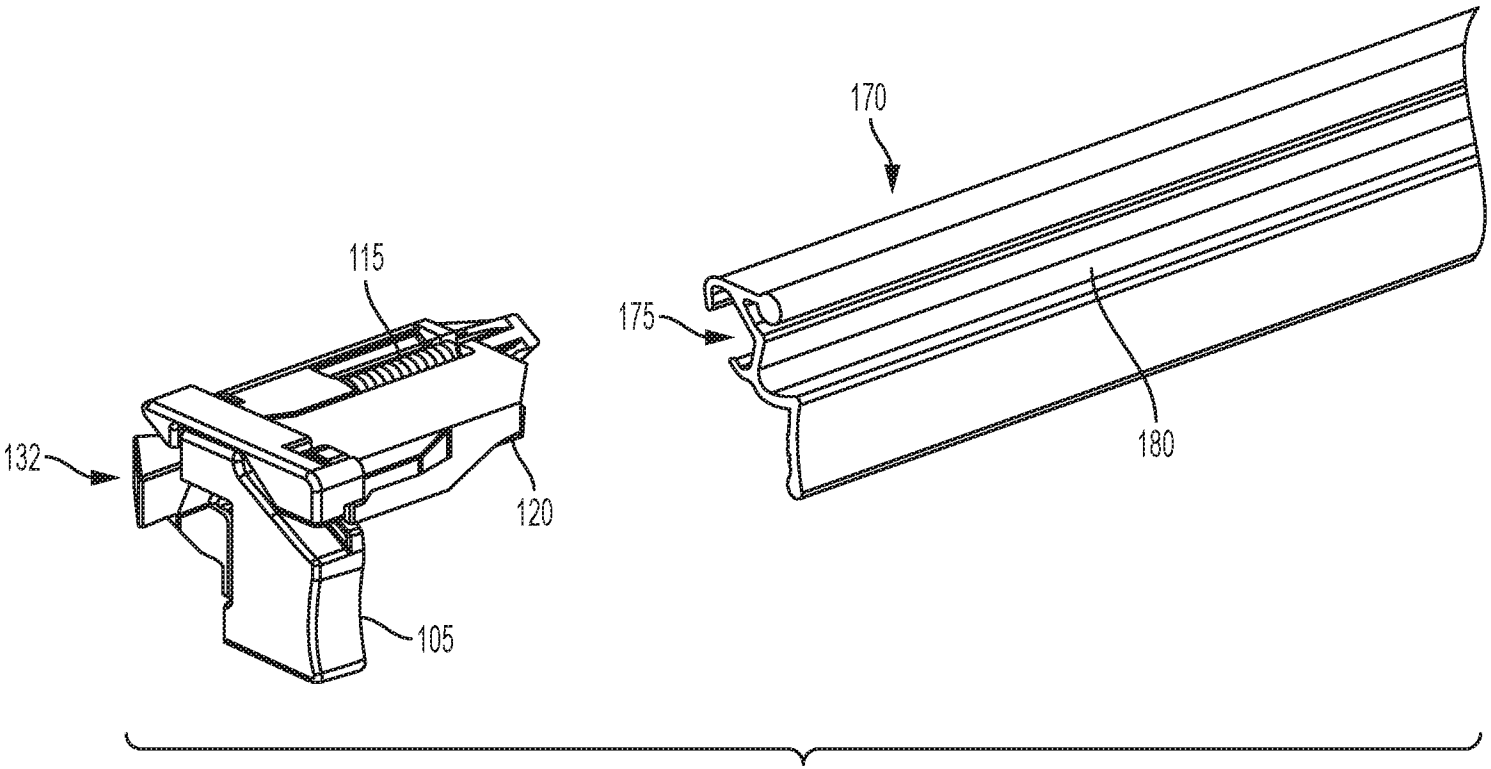
FIG. 2 is a perspective view of a latch not installed in a drawer front according to at least some embodiments of the present invention.
Figure 3:
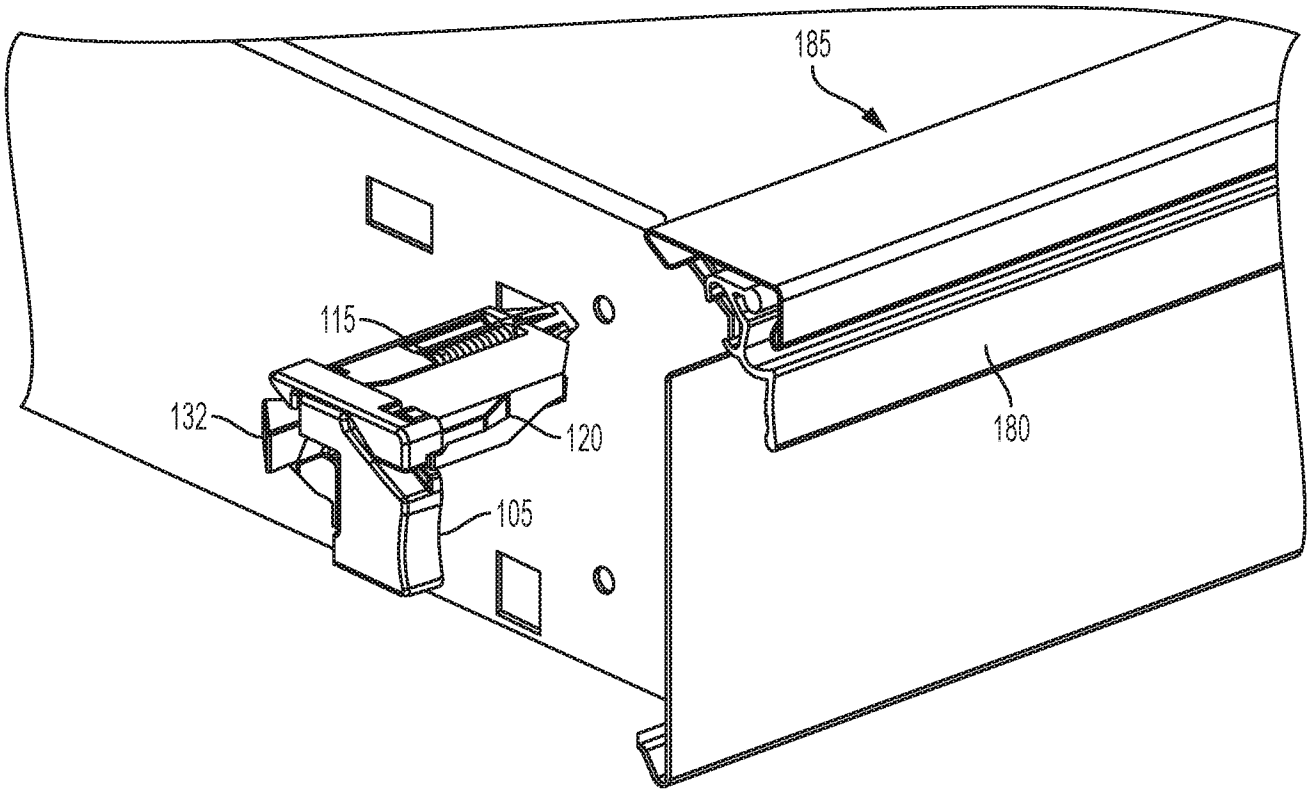
FIG. 3 is a perspective view of a latch not installed in a handle and drawer according to at least some embodiments of the present invention.

As shown in FIG. 2, a front 170 can include an opening 175 that receives a portion of the latch 100 in, for example, a friction-fit, interference-fit, or snap-fit configuration to couple the latch 100 to an enclosure. The front 170 can further include a handle 180 that can be pulled to thereby rotate the end cap 105 and, in doing so, disengage the catch 132 from an opening on a strike plate or other object, thereby unlatching the latch and allowing the enclosure to be opened. As shown in FIGS. 3-6, the front 180 can be coupled to or integral with a drawer body 185. However, as used herein, the term "enclosure" need not be limited to a drawer, and can be, for example, a cabinet, door, drawer, box, or any other enclosure.

Figure 4:
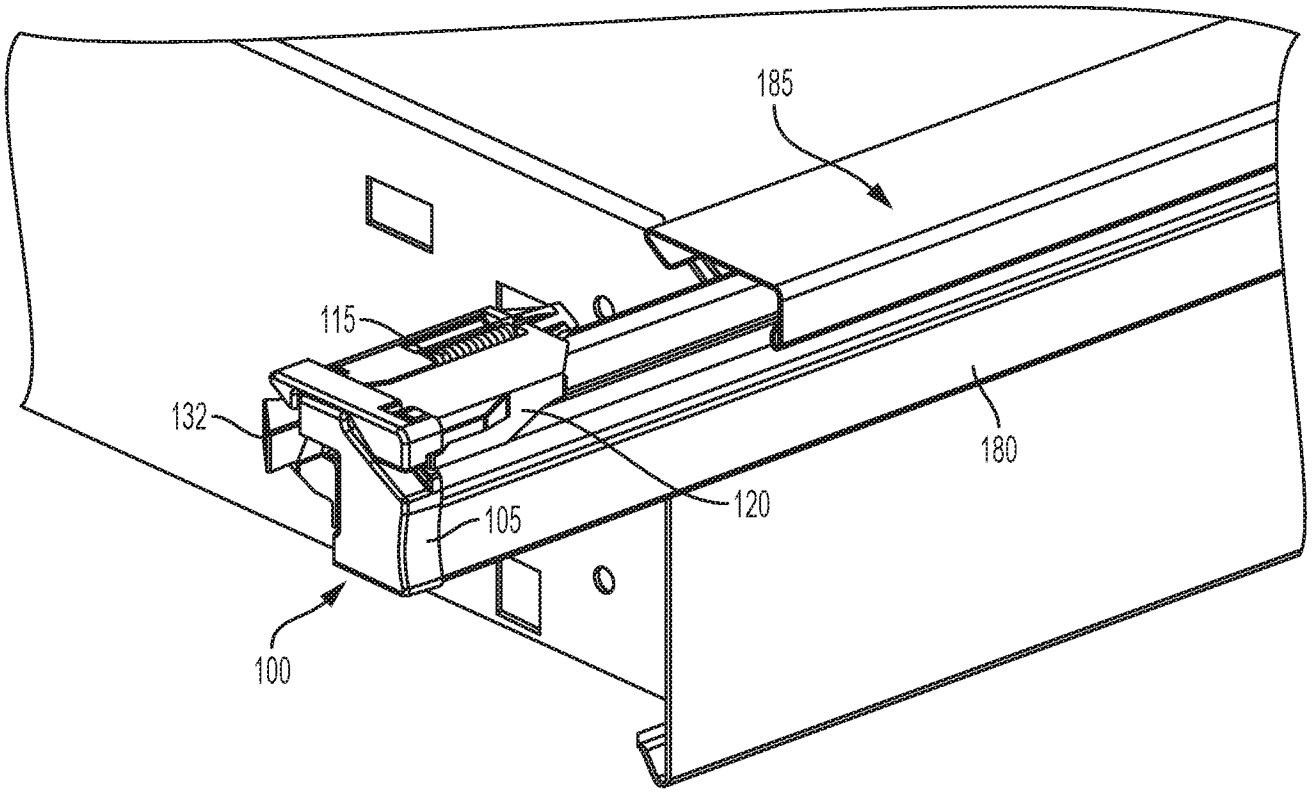
FIG. 4 is a partially exploded perspective view of a latch, handle, and drawer showing the latch and handle being inserted into the drawer according to at least some embodiments of the present invention.
Figure 5:
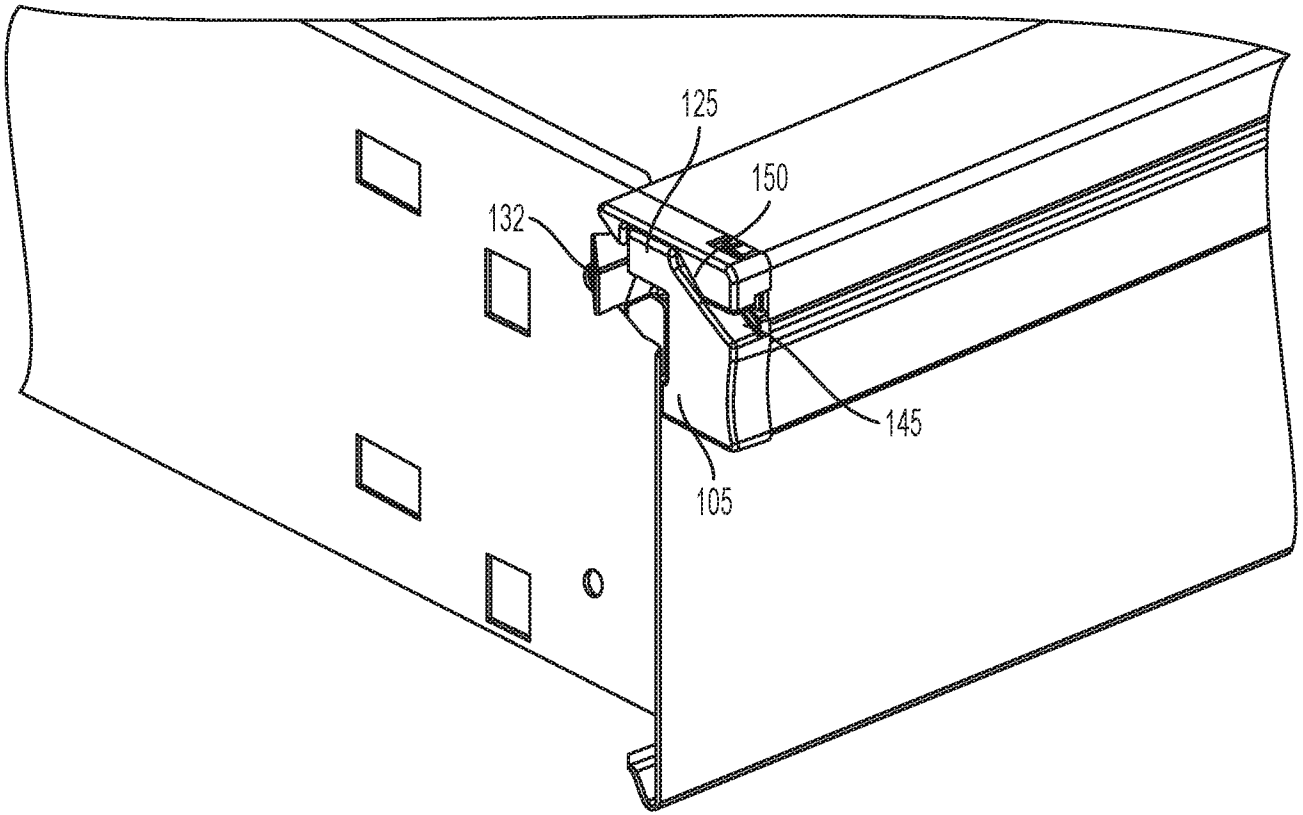
FIG. 5 is a front perspective view of a latch inserted into a drawer with a handle, where the latch is in the closed or latched position.

FIGS. 4 and 5 illustrate the latch 100 and front 180 being inserted into the drawer body 185. As shown, the latch 100 and front 180 can be coupled together and then inserted into the drawer body 185 in a well-known manner, for example, a snap-fit, interference-fit, friction-fit, or other coupling engagement. Alternately, the latch 100 and front 180 can be welded, glued, or otherwise coupled to the drawer body 185 in any manner.

As shown in FIGS. 5 and 6, the latch 100 can be unlatched by pulling on the handle 180, which then rotates the end cap 105. The first surface 145 (of the end cap 105) will then engage the second surface 150 (of the holder 120) to apply a prying motion and more easily rotate the end cap 105. The end cap 105 can then cause the body 110 to move linearly inward against the bias of the spring 115, and therefore disengage the catch 132, by pushing the portion 125 of the end cap 105 against the cam surface 130 of the body 110. The user can therefore apply an outwardly pulling force on the handle 180, and disengage the catch 132 from the opening of the strike plate, cabinet, or other member, to unlatch and latch the latch 100 as the user chooses.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A latch for an enclosure including an opening, the latch comprising:

an end cap having an end cap portion and a first cam surface;

a handle coupled to the end cap and configured to rotate the end cap;

a body having a body cam surface that engages the end cap portion to cause the body to move linearly inwardly when the end cap portion abuts the body cam surface, the body further includes a catch that is adapted to engage or disengage the opening based on linear movement of the body;

a spring adapted to bias the body in an outwardly direction; and a holder adapted to receive the body and having an abutment that is adapted to receive the spring to bias the body in the outwardly direction, the holder includes a second cam surface that is adapted to engage the first cam surface when the end cap is rotated.

2. The latch of claim 1, wherein the body further includes an extension adapted to receive the spring.

3. The latch of claim 2, wherein the extension is rod shaped and is adapted to be inserted through the spring along a central axis of the spring.

4. The latch of claim 1, wherein the end cap includes a tab adapted to prevent lateral movement of the end cap, the holder includes an aperture adapted to receive the tab, and the tab is movably disposed in the aperture when the end cap is rotated.

5. The latch of claim 1, wherein the abutment includes a recess that is adapted to receive the spring.

6. The latch of claim 1, wherein the end cap includes a protrusion that is adapted to couple to the enclosure.

7. An enclosure that is adapted to open and close, the enclosure comprising:

a latch including;

an end cap having an end cap portion and a first cam surface;

a body having a body cam surface that engages the end cap portion to cause the body to move linearly inwardly when the end cap portion abuts the body cam surface, the body further includes a catch that is adapted to engage or disengage an opening of the enclosure based on linear movement of the body;

a spring that is adapted to bias the body in an outwardly direction; and a holder that is adapted to receive the body and having an abutment that is adapted to receive the spring to bias the body in the outwardly direction, the holder includes a second cam surface that is adapted to engage the first cam surface when the end cap is rotated;

a handle coupled to the latch at the end cap; and an enclosure body that is adapted to receive the handle and the latch.

8. The enclosure of claim 7, wherein the body further includes an extension that is adapted to receive the spring.

9. The enclosure of claim 8, wherein the extension is rod shaped and is adapted to be inserted through the spring along a central axis of the spring.

10. The enclosure of claim 7, wherein the end cap includes a tab that is adapted to prevent lateral movement of the end cap, the holder includes an aperture that is adapted to receive the tab, and the tab is movably disposed within the aperture during rotation of the end cap.

11. The enclosure of claim 7, wherein the abutment includes a recess that is adapted to receive the spring.

12. The enclosure of claim 7, wherein the end cap includes a protrusion that couples to the enclosure body.

13. The enclosure of claim 7, wherein the end cap is coupled to the handle and movement of the handle causes rotation of the end cap.

14. The enclosure of claim 13, wherein movement of the handle causes the end cap portion to abut the body cam surface to cause the body to move linearly inwardly to disengage the catch from the opening.

15. A method of allowing an enclosure to be opened, comprising:

providing a latch including an end cap having an end cap portion and a first cam surface, a body having a body cam surface that engages the end cap portion to cause the body to move linearly inwardly when the end cap portion abuts the body cam surface, the body further including a catch that is adapted to engage or disengage an opening of the enclosure based on linear movement of the body, a spring that is adapted to bias the body in an outwardly direction, and a holder that is adapted to receive the body and having an abutment for that is adapted to receive the spring to bias the body in the outwardly direction, the holder including a second cam surface that is adapted to engage the second cam surface when the end cap is rotated;

rotating a handle coupled to the end cap;

disengaging the catch from the opening in response to the rotation of the handle.

* * * * *